US009725884B2

(12) United States Patent
Hashimoto

(10) Patent No.: US 9,725,884 B2
(45) Date of Patent: Aug. 8, 2017

(54) HYDRAULIC CIRCUIT FOR CONSTRUCTION MACHINE AND CONTROL DEVICE FOR SAME

(71) Applicant: SUMITOMO(S.H.I.) CONSTRUCTION MACHINERY CO., LTD., Tokyo (JP)

(72) Inventor: Hirofumi Hashimoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 325 days.

(21) Appl. No.: 14/525,322

(22) Filed: Oct. 28, 2014

(65) Prior Publication Data

US 2015/0040552 A1 Feb. 12, 2015

Related U.S. Application Data

(63) Continuation of application No. PCT/JP2013/060959, filed on Apr. 11, 2013.

(30) Foreign Application Priority Data

Jul. 2, 2012 (JP) ..... 2012-148928

(51) Int. Cl.
*F15B 11/17* (2006.01)
*E02F 9/22* (2006.01)
*F15B 11/16* (2006.01)

(52) U.S. Cl.
CPC ..... *E02F 9/2282* (2013.01); *E02F 9/2242* (2013.01); *E02F 9/2267* (2013.01); (Continued)

(58) Field of Classification Search
CPC ..... F15B 11/16; F15B 11/17; E02F 9/2282
See application file for complete search history.

(56) References Cited

U.S. PATENT DOCUMENTS 5,941,155 A * 8/1999 Arai ..... E02F 9/123 60/468
5,950,430 A * 9/1999 Tohji ..... E02F 9/123 60/426
2007/0240562 A1 10/2007 Kim

FOREIGN PATENT DOCUMENTS

EP 1577563 9/2005
EP 2157245 2/2010
(Continued)

OTHER PUBLICATIONS

International Search Report mailed on May 14, 2013.

*Primary Examiner* — Thomas E Lazo
(74) *Attorney, Agent, or Firm* — IPUSA, PLLC

(57) ABSTRACT

A hydraulic circuit of a construction machine including center bypass passages, into which a pressurized oil from hydraulic pumps is supplied, includes a directional control valve group in tandem with the center bypass passages; a bleed-off valve on a downstream side of each center bypass passage; and a merging circuit that merges the pressurized oil supplied into one center bypass passage and that in another center bypass passage, wherein each directional control valve includes a first internal passage that flows the pressurized oil into the center bypass passages, and a second internal passage that supplies the pressurized oil to a hydraulic actuator, wherein the center bypass passages and the first internal passage form a parallel passage, wherein an opening area of the bleed-off valve is changed, wherein the merging circuit includes a merging directional control valve that controls an inflow direction of the pressurized oil to be merged.

7 Claims, 12 Drawing Sheets

(52) U.S. Cl.
CPC ..... *E02F 9/2292* (2013.01); *F15B 11/16* (2013.01); *F15B 11/17* (2013.01); *F15B 2211/20546* (2013.01); *F15B 2211/20576* (2013.01); *F15B 2211/30595* (2013.01); *F15B 2211/31517* (2013.01); *F15B 2211/327* (2013.01); *F15B 2211/41554* (2013.01); *F15B 2211/45* (2013.01); *F15B 2211/6346* (2013.01); *F15B 2211/6652* (2013.01); *F15B 2211/6654* (2013.01); *F15B 2211/7142* (2013.01)

(56) References Cited

FOREIGN PATENT DOCUMENTS

| | | | | |
|---|---|---|---|---|
| JP | S61-038204 | | | 2/1986 |
| JP | H02-186106 | | | 7/1990 |
| JP | 02248706 | A | * | 10/1990 |
| JP | H02-248706 | | | 10/1990 |
| JP | H10-018359 | | | 1/1998 |
| JP | H10-147959 | | | 6/1998 |
| JP | H11-107328 | | | 4/1999 |
| JP | H11-257302 | | | 9/1999 |
| JP | 2000-009102 | | | 1/2000 |
| JP | 2006-132700 | | | 5/2006 |
| JP | 2007-120004 | | | 5/2007 |
| JP | 2007-285520 | | | 11/2007 |

* cited by examiner

HYDRAULIC CIRCUIT FOR CONSTRUCTION MACHINE AND CONTROL DEVICE FOR SAME

RELATED APPLICATION

This application is a continuation application filed under 35 U.S.C. 111(a) claiming the benefit under 35 U.S.C. 120 and 365(c) of a PCT International Application No. PCT/JP2013/060959 filed on Apr. 11, 2013, which is based upon and claims the benefit of priority of the prior Japanese Patent Application No. 2012-148928 filed on Jul. 2, 2012, the entire contents of which are incorporated herein by reference.

BACKGROUND

Technical Field

The present invention relates to a hydraulic circuit for a construction machine and a control device for the same.

Description of Related Art

Some construction machines perform a control (a bleed-off control) of returning a part (e.g., an excess) of a pressurized oil discharged from a hydraulic pump to an operating oil tank. In order to perform the bleed-off control, some construction machines have a gap (e.g., a bleed opening Sbo) for returning the pressurized oil in a spool of a directional control valve. For example, some construction machine perform the bleed-off control by changing the opening area of the bleed opening.

SUMMARY

According to one aspect of the invention, there is provided a hydraulic circuit of a construction machine including a plurality of center bypass passages, into which a pressurized oil discharged from a plurality of hydraulic pumps is supplied, including a directional control valve group including a plurality of directional control valves that are arranged in tandem with the center bypass passages; a bleed-off valve arranged on a downstream side of each center bypass passage relative to the directional control valve group; and a merging circuit that merges the pressurized oil supplied into one center bypass passage of the plurality of center bypass passages and the pressurized oil in another center bypass passage of the plurality of center bypass passages, wherein each directional control valve includes a first internal passage that flows the pressurized oil supplied into the directional control valve out into the center bypass passages, and a second internal passage that supplies the pressurized oil supplied to the directional control valve to a hydraulic actuator of the construction machine, wherein the center bypass passages and the first internal passage form a parallel passage where the first internal passage flows the pressurized oil discharged from the hydraulic pump out onto downstream sides of the center bypass passages relative to the directional control valve, wherein the bleed-off valve performs a bleed-off control for the pressurized oil supplied through the parallel passage by changing an opening area of the bleed-off valve, wherein the merging circuit includes a merging directional control valve that controls an inflow direction of the pressurized oil to be merged.

DETAILED DESCRIPTION

Figure 1:
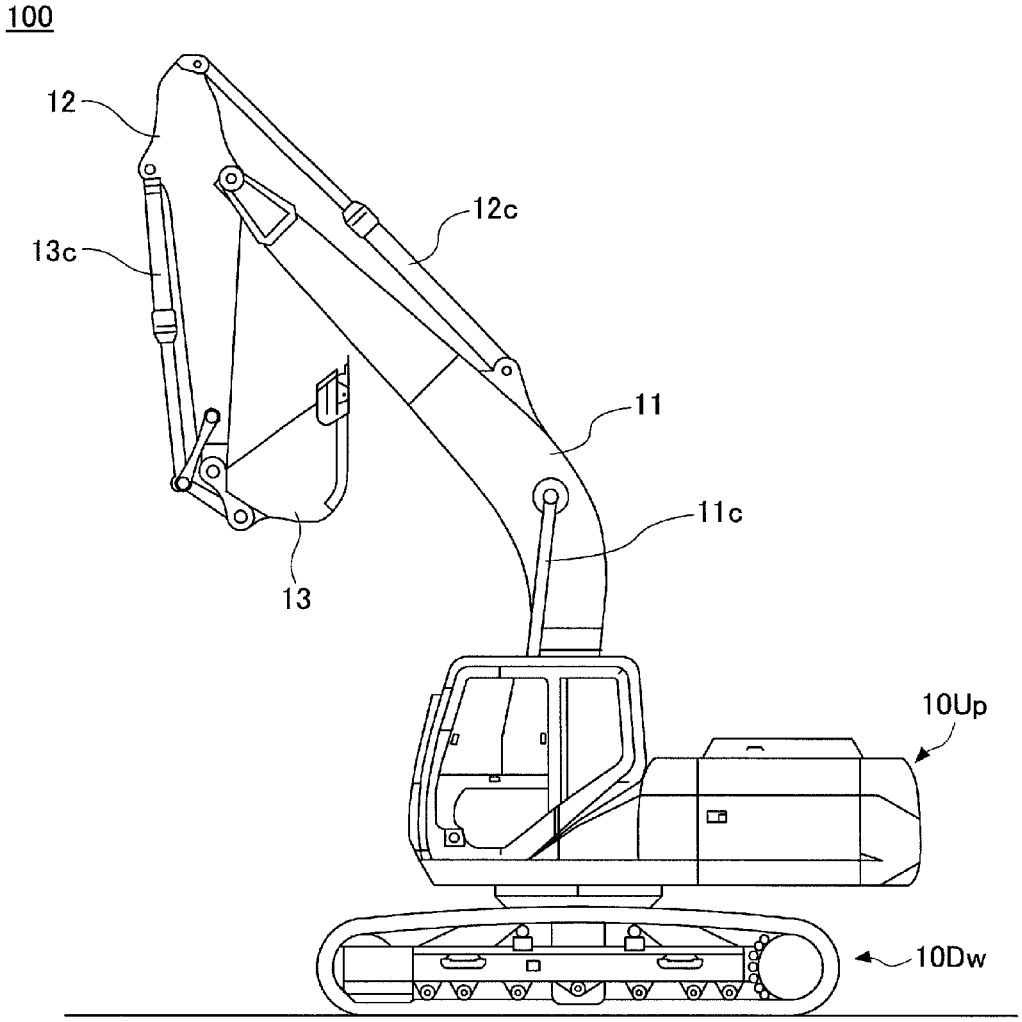
FIG. 1 illustrates an schematic outer appearance for explaining an exemplary construction machine of the embodiment of the present invention.

According to the above Related Art, the amount of the pressurized oil (an operating oil) supplied to a hydraulic actuator differs depending on an object of a work. Therefore, in some construction machines having multiple hydraulic pumps, pressurized oils discharged from the hydraulic pump are merged to keep the amount of the pressurized oil supplied to the hydraulic actuator.

However, in a case where the merging circuit is added to the above technique disclosed, it is necessary to provide a cut valve Vct and an output port Pout to cause the pressurized oil to be flown out and further provide an input port Pin to cause the pressurized oil to be flown in (merged). Therefore, there is case where a passage (for example, an outer passage connecting the output port Pout and the input port Pin) of the hydraulic circuit is complicated and the pressure loss of the pressurized oil increases. Further, in a case where the merging circuit is added to the above technique, it is necessary to provide another set of a cut valve Vct, an output port Pout, and so on in order to merge the pressurized oils bi-directionally. Said differently, in a case where the merging circuit is added to the above technique, the size of the hydraulic circuit of the construction machine may become great by existences of the cut valve Vct, the output port Pout, and so on.

An embodiment of the present invention is provided under this situation, and the embodiment is to provide a hydraulic circuit of a construction machine that includes multiple center bypass passages to which pressurized oil discharged from multiple hydraulic pumps are respectively supplied and a merging circuit for merging the pressurized oil supplied to a center bypass passage thereby enabling a control of the pressurized oil to be merged, and a control device for the construction machine.

There is provided the hydraulic circuit of the construction machine wherein the first internal passage may have substantially a same passage area regardless of a position of a spool included in each directional control valve and may form the parallel passage corresponding to the passage area, wherein the directional control valve group may be supplied with the pressurized oil from only the parallel passage.

According to another aspect of the invention, there is provided a hydraulic circuit of a construction machine including a plurality of center bypass passages, into which a pressurized oil discharged from a plurality of hydraulic pumps is supplied, including a directional control valve group including a plurality of directional control valves that are arranged in tandem with the center bypass passages; a bleed-off valve arranged on a downstream side of each center bypass passage relative to the directional control valve group; and a merging circuit that merges the pressurized oil supplied into one center bypass passage of the plurality of center bypass passages and the pressurized oil in another center bypass passage of the plurality of center bypass passages, wherein each directional control valve may include a first internal passage that flows the pressurized oil supplied into the directional control valve out into the center bypass passages, and a second internal passage that supplies the pressurized oil supplied to the directional control valve to a hydraulic actuator of the construction machine, wherein the center bypass passages and the first internal passage may form a parallel passage where the first internal passage flows the pressurized oil discharged from the hydraulic pump out onto downstream sides of the center bypass passages relative to the directional control valve, wherein the bleed-off valve may perform a bleed-off control for the pressurized oil supplied through the parallel passage by changing an opening area of the bleed-off valve, wherein the merging circuit may include a merging directional control valve that controls an inflow direction of the pressurized oil to be merged, wherein a number of the plurality of hydraulic pumps may be two, wherein a number of the plurality of center bypass passages may be two, wherein the merging directional control valve may switch over the inflow direction to supply one of pressurized oils respectively supplied to the two center bypass passages to the center bypass passage to which another of the pressurized oils is supplied.

Further, there is provided the hydraulic circuit of the construction machine, wherein the merging circuit may further include a check valve corresponding to the inflow direction, and prevents the pressurized oil from flowing in a direction inverse to the inflow direction.

According to another aspect of the invention, there is provided a control device for controlling a hydraulic circuit of a construction machine including a plurality of center bypass passages, into which a pressurized oil discharged from a plurality of hydraulic pumps is supplied, including a directional control valve group including a plurality of directional control valves that are arranged in tandem with the center bypass passages; a bleed-off valve arranged on a downstream side of each center bypass passage relative to the directional control valve group; and a merging circuit that merges the pressurized oil supplied into one center bypass passage of the plurality of center bypass passages and the pressurized oil in another center bypass passage of the plurality of center bypass passages, wherein each directional control valve may include a first internal passage that flows the pressurized oil supplied into the directional control valve out into the center bypass passages, and a second internal passage that supplies the pressurized oil supplied to the directional control valve to a hydraulic actuator of the construction machine, wherein the center bypass passages and the first internal passage may form a parallel passage where the first internal passage flows the pressurized oil discharged from the hydraulic pump out onto downstream sides of the center bypass passages relative to the directional control valve, wherein the bleed-off valve may perform a bleed-off control for the pressurized oil supplied through the parallel passage by changing an opening area of the bleed-off valve, wherein the merging circuit may include a merging directional control valve that controls an inflow direction of the pressurized oil to be merged.

Further, there is provided the control device for the hydraulic circuit of the construction machine, wherein the inflow direction may be changed in response to operation information input into the construction machine.

Further, there is provided the control device for the hydraulic circuit of the construction machine, wherein the opening area of the bleed-off valve may be decreased in a case where the pressurized oil is merged by the merging circuit.

Further, there is provided the control device for the hydraulic circuit of the construction machine, wherein the hydraulic actuator corresponding to the directional control valve, into which the pressurized oil that is merged is supplied, may be preferentially operated.

According to the hydraulic circuit of the construction machine of the embodiment of the present invention and the control device for the construction machine, a merging circuit and a merging directional control valve are used to control the inflow direction of the pressurized oil to be merged.

With reference to the figures, description is given below of non-limiting embodiments of the present invention. In all the figures attached thereto, the same or corresponding reference symbols are attached to the same or corresponding members and parts, and description of overlapping explanation is omitted. Further, relative ratios among the members and parts are not considered in figures. Therefore, specific dimensions can be determined by a person ordinarily skilled in art in light of the non-limiting embodiments described below.

Hereinafter, a construction machine 100 including a hydraulic circuit 20 of the embodiment of the present invention and a device 30 of controlling the hydraulic circuit are used in describing the present invention. Further, the present invention is applicable to other than the embodiment as long as a construction machine includes multiple center bypass passages (center bypass lines), flows back (performs a bleed-off control) a part of a pressurized oil using a cut valve (a bleed-off valve, a flow control valve, etc.), and supplies (merges) the pressurized oil supplied to one center bypass passage of the multiple center bypass passages. Further, the construction machine to which the present invention is applicable is a hydraulic shovel, a crane vehicle, a bulldozer, a wheel loader, a dump truck, a pile hammer, a pile extractor, a water jet, mud discharging water processing facilities, a grout mixer, a construction machine for deep fundamental, a boring machine, or the like.

(Structure of Construction Machine)

Referring to FIG. 1, a schematic structure of a construction machine 100, to which the present invention is applicable, is described. Here, the construction machine of the embodiment is a machine performing a desired work using a hydraulic actuator.

Referring to FIG. 1, the construction machine 100 includes hydraulic actuators such as a boom 11 whose base end portion is supported by an upper-part swiveling body 10Up so as to be rotatable, an arm 12 which is supported by a tip end of the boom 11 so as to be rotatable, and a bucket 13 supported by a tip end of the arm 12 so as to be rotatable.

In the construction machine 100, the boom cylinder 11*c* is expanded and contracted in a longitudinal direction of the boom cylinder 11*c* by supplying the operating oil (the pressurized oil) to the boom cylinder 11*c* of the boom 11. At this time, the boom 11 is driven in upward and downward directions by the expansion and contraction of the boom cylinder 11*c*. The construction machine 100 controls the operating oil supplied to the boom cylinder 11*c* using a directional control valve (e.g., Vb1 and Vb2 illustrated in FIG. 2 described later) for the boom which is controlled in response to the operation amount and the operation direction of an operation lever operated by an operator (a driver, a worker). As a result, the construction machine 100 performs a desired work in response to the operation amount or the like of the operation lever operated by the operator.

Further, in the construction machine 100, in a manner similar to the boom 11, the arm 12 and the bucket 13 are driven by expansion and contraction of the arm cylinder 12*c* and a bucket cylinder 13*c*. In the construction machine 100, in a manner similar to the boom cylinder 11*c*, the operating oil supplied to the arm cylinder 12*c* and the bucket cylinder 13*c* is controlled by a directional control valve for the arm (e.g., Va1 and Va2 illustrated in FIG. 2) and a directional control valve for the bucket (e.g., Vbk illustrated in FIG. 2).

Further, a main body of the construction machine 100 travels (movements in the forward, backward, rightward, and leftward directions) and rotates (a swivel motion) using wheels and a swiveling apparatus (e.g., the lower-part traveling body 10Dw). The construction machine 100 uses a directional control valve for travel (e.g., Vt1, Vt2, and Vst illustrated in FIG. 2) or the like to cause the construction machine 100 to travel in response to the operation amount of the operation lever operated by the operator.

The construction machine 100, to which the present invention is applicable, further includes the hydraulic circuit 20 (described later) for supplying the operating oil (the pressurized oil) from the hydraulic pump to the hydraulic actuator and a device 30 (described later) for controlling operations of elements of the construction machine 100.

Hereinafter, the hydraulic circuit 20 of the construction machine 100 and the device 30 of controlling the construction machine 100 are specifically described.

(Hydraulic Circuit of Construction Machine)

Figure 2:
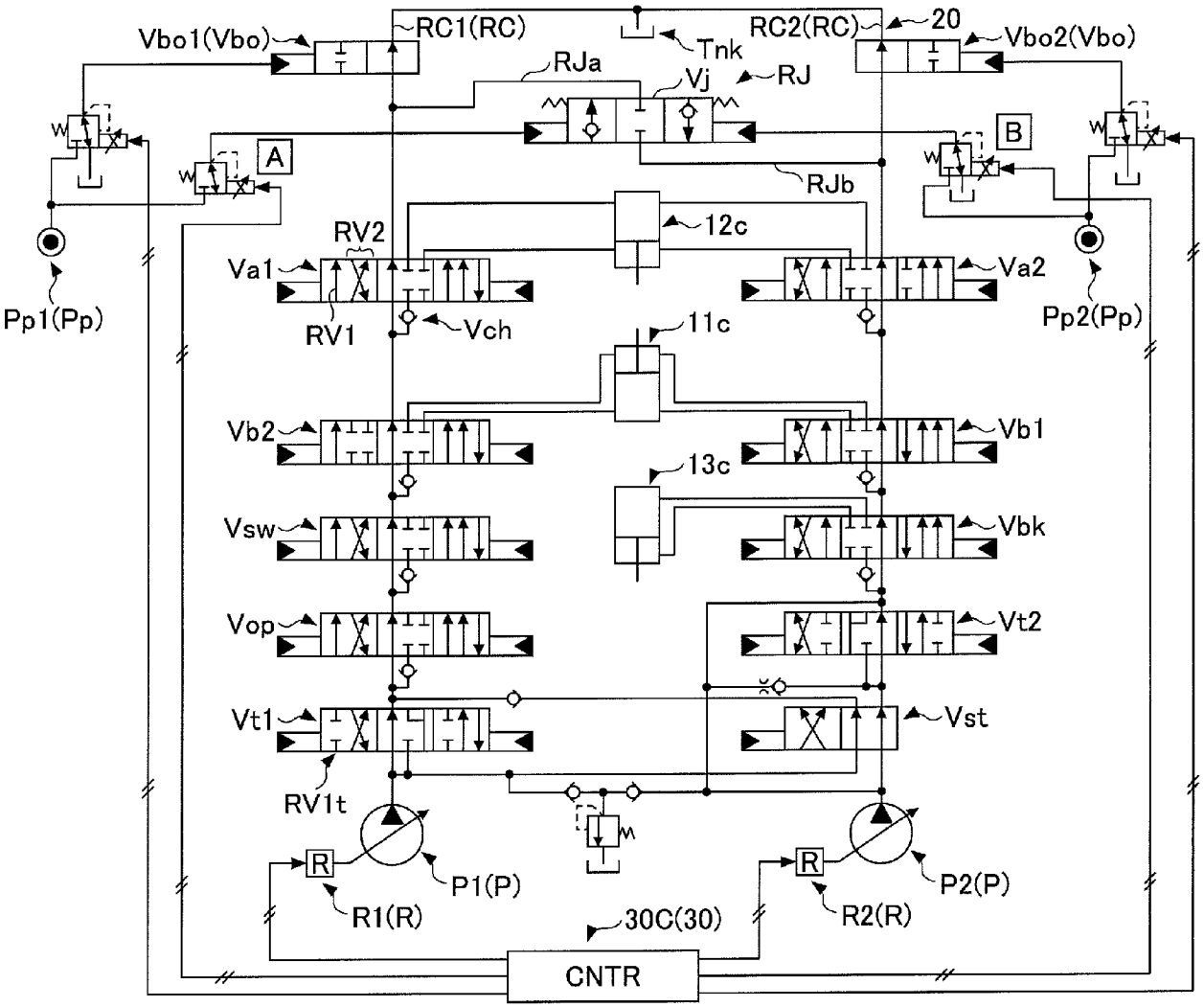
FIG. 2 illustrates a hydraulic circuit for explaining an exemplary hydraulic circuit of the construction machine of the embodiment of the present invention.

Referring to FIG. 2, the hydraulic circuit 20 of the construction machine 100 of the embodiment of the present invention is described. Referring to FIG. 2, solid lines indicate oil passages (passages of the pressurized oil). However, solid lines marked with "//" indicate an electric control system.

The hydraulic circuit, to which the present invention is applicable, is not limited to that illustrated in FIG. 2. Said differently, the present invention is applicable to any hydraulic circuit as long as the hydraulic circuit includes multiple center bypass passages and is provided with a cut valve (a bleed-off valve) in a center bypass passage on the downstream side of the multiple directional control valves (a directional control valve group). Further, although the hydraulic circuit 20 has two hydraulic pumps, the hydraulic circuit, to which the present invention is applicable, is not limited to that having two hydraulic pumps. Said differently, the present invention is applicable to the hydraulic circuit (the construction machine) having three or more hydraulic pumps.

As illustrated in FIG. 2, the hydraulic circuit 20 of the construction machine 100 of the embodiment of the present invention includes two hydraulic pumps P (first and second hydraulic pumps) mechanically connected to an output shaft of a power source (not illustrated) such as a generating machinery, an engine, a motor, or the like, two center bypass passages RC (a first center bypass passage RC1 and a second center bypass passage RC2), to which the pressurized oil is discharged from the two hydraulic pumps P, respectively, a directional control valve (a first directional control valve Vt1 for travel or the like) for controlling the hydraulic actuator (e.g., the boom 11 or the like), and a directional control valve (a straight travel valve) Vst for straight travel. Further, the hydraulic circuit 20 includes a bleed-off valve Vbo (a first bleed-off valve Vbo1 and a second bleed-off valve Vbo2) arranged on the downstream side (for example, the most downstream side) of the center bypass passage RC. Furthermore, the hydraulic circuit 20 has a merging circuit RJ which supplies the pressurized oil supplied into the multiple center bypass passages to another center bypass passage (hereinafter, referred to as "merging").

According to the hydraulic circuit 20 of the embodiment, the directional control valves (Vt1 or the like) is arranged in the center bypass passage RC in series, and the bleed-off valve Vbo is arranged in a downstream side of the center bypass passage RC. Specifically, in the hydraulic circuit 20, the first center bypass passage RC1 corresponding to the first hydraulic pump P1 includes the first directional control valve Vt1 for travel (e.g., a directional control valve for left travel), an auxiliary directional control valve Vop, a directional control valve Vsw for swivel, the directional control valve Vb2 for a second boom, the directional control valve Va1 for a first arm, and the first bleed-off valve Vbo1, which are arranged in series. Further, in the hydraulic circuit 20, the second center bypass passage RC2 corresponding to the second hydraulic pump P2 includes the second directional control valve Vt2 for travel (e.g., a directional control valve for right travel), a directional control valve Vbk for a bucket, the directional control valve Vb1 for a first boom, the directional control valve Va2 for a second arm, and the second bleed-off valve Vbo2, which are arranged in series. Further, the hydraulic circuit 20 is provided with the straight travel valve Vst on the upstream side of the second center bypass passage RC2.

Said differently, in the hydraulic circuit 20, multiple directional control valves are arranged in series in the center bypass passage RC. Further, in the hydraulic circuit 20, the directional control valves are arranged in tandem by arranging multiple directional control valves in the two center bypass passages RC1 and RC2, respectively, in series so that the directional control valves are arranged in tandem. In the following explanation, a group of the multiple directional control valves arranged in tandem in the center bypass passage RC is referred to as a "directional control valve group".

In the hydraulic circuit 20 of the embodiment, a remote control pressure (a secondary pressure of a remote control valve) generated in response to operation information (e.g., information related to the operation amount, information related to the operation direction, hereinafter, referred to as "operation information") is input in the directional control valve (e.g., Vt1) corresponding to an operation of an operation lever operated by an operator. At this time, the directional control valve switches the position of the spool in response to the remote control pressure introduced into the both ends of the spool (a flow rate control spool), and controls the flow rate (the operation amount) and the direction (the operation direction) of the pressurized oil (the operating oil).

Further, in the hydraulic circuit 20 of the embodiment, a part (an excess) of the pressurized oil discharged from the hydraulic pump P (e.g., P1) is flown back to an operating oil tank Tnk (the bleed-off control) using the bleed-off valve Vbo (e.g., Vbo1) that is arranged on the downstream side of the center bypass passage RC (e.g., RC1). With this, in the construction machine 100, the flow rate of the operating oil (the pressurized oil) supplied to the hydraulic cylinder (e.g., 11*c*) is controlled and the drive (the operation) of the hydraulic actuator (e.g., 11 illustrated in FIG. 1) is controlled.

The bleed-off valve Vbo of the embodiment can be set at an unloading position where the opening area of the bleed-off valve Vbo is maximum and a blocking position where the opening area of the bleed-off valve Vbo is zero. The bleed-off valve Vbo is switched from the unloading position to the blocking position using (the pressure of) the pressurized oil of a pilot pump Pp controlled by the control device for the construction machine. Thus, the opening area of the bleed-off valve Vbo is changed. With this the bleed-off valve Vbo can flow back (return) the pressurized oil by a desirable flow rate corresponding to the changed opening area to the operating oil tank.

In the hydraulic circuit 20 of the construction machine 100 of the embodiment, the pressurized oil supplied to one center bypass passage is merged to another center bypass passage using the merging circuit RJ. Here, within the embodiment, the merging circuit RJ includes a merging directional control valve RJ that controls a flowing direction (hereinafter, referred to as an "inflow direction") of the pressurized oil supplied into the merging circuit RJ as illustrated in FIG. 2. Further, within the embodiment, the merging circuit RJ inputs the pressurized oil provided by the pilot pump Pp (a first pilot pump Pp1 and a second pilot pump Pp2) to a pilot port (a control port) of the merging directional control valve Vj. With this, the hydraulic circuit 20 (the merging circuit RJ) controls the merging directional control valve Vj.

Specifically, the merging circuit RJ of the embodiment uses the merging directional control valve Vj based on operation information input by the operator using the operation lever so that it is selected (controlled) to merge the pressurized oil supplied to the center bypass passage RC1 and the pressurized oil supplied to the center bypass passage or to merge the pressurized oil supplied to the center bypass passage RC2 and the pressurized oil supplied to the center bypass passage RC1. Said differently, the hydraulic circuit 20 (the merging circuit RJ) of the construction machine 100 of the embodiment can merge the pressurized oils in both directions toward the center bypass passages RC1 and RC2.

The operation of merging the pressurized oils using the merging circuit RJ or the like in the hydraulic circuit 20 is described later in (Operation of merging pressurized oil). The hydraulic circuit 20 (the merging circuit RJ) of the construction machine 100, to which the present invention is applicable, may be structured so that the pressurized oil merges into only one of the center bypass passages RC1 and RC2.

(Internal Passage of Directional Control Valve)

An internal passage RV of the directional control valve arranged in the hydraulic circuit 20 of the construction machine 100 of the embodiment is described as follows.

The hydraulic circuit 20 of the embodiment includes the directional control valve group (the multiple directional control valves). Further, each of the directional control valves of the embodiment includes, as the internal passage RV, a first internal passage for flowing the pressurized oil, which is supplied, into the center bypass passage RC and a second internal passage for flowing the pressurized oil, which is supplied, into the hydraulic actuator. Said differently, each of the multiple directional control valves forming the directional control valve group includes the first internal passage and the second internal passage.

Further, the opening of the first internal passage is not completely closed in a case where the position of the spool of the directional control valve is switched over. Said differently, the passage area of the first internal passage of the embodiment is substantially the same regardless of the position of the spool of the directional control valve. The substantially same passage area means that an effective passage area, through which the pressurized oil actually passes, does not substantially change in comparison with the passage area changing by the position change of the spool.

With this, in the hydraulic circuit 20 of the construction machine 100, a parallel passage can be formed by the center bypass passage RC and the first internal passage. In the hydraulic circuit 20 of the embodiment, the parallel passage corresponding to the passage area of the first internal passage can be formed. Further, in the hydraulic circuit 20, the pressurized oil can be supplied from only the formed parallel passage to the directional control valve group (the multiple directional control valves).

Among the multiple directional control valves, the directional control valve for travel (e.g., Vt1, Vt2 illustrated in FIG. 2) may be structured so that the opening of the first internal passage is completely closed (for example, RV1*t* illustrated in FIG. 2). With this, (the hydraulic circuit 20 of) the construction machine 100 can maintain stability of travel (the flow rate of the operating oil necessary for the travel) during the travel.

Further, in the directional control valve of the embodiment, (the spool of) the first internal passage is not provided with a gap (hereinafter, a "bleed opening") for returning the pressurized oil to an operating oil tank. In the hydraulic circuit 20 of the embodiment, the bleed-off control (a standardized bleed-off control) can be performed using the bleed-off valve Vbo arranged on the most downstream side of the center bypass passage RC as described above.

The second internal passage of the embodiment is the internal passage (e.g., RV2 illustrated in FIG. 2) for supplying the pressurized oil to the hydraulic cylinder (e.g., the arm cylinder 12*c* illustrated in FIG. 2). The second internal passage supplies the pressurized oil discharged from the hydraulic pump P to the hydraulic cylinder (e.g., the arm cylinder 12*c* illustrated in FIG. 2). The second internal passage of the embodiment changes the route of the internal passage and changes the flow rate of the pressurized oil (the operating oil) supplied to the hydraulic cylinder and the direction (the operation direction) of the pressurized oil supplied to the hydraulic cylinder in a case where the position of the spool of the directional control valve is switched by the input remote control pressure. With this, the directional control valve (the construction machine 100) can control the operation of the hydraulic cylinder (the hydraulic actuator).

An example of the internal passage RV (a shape of the spool) of the directional control valve arranged in the hydraulic circuit 20 of the construction machine 100 is specifically described with reference to FIGS. 3A-3C. The directional control valve (e.g., the shape of the spool) which can be used in the present invention is not limited to those illustrated in FIGS. 3A-3C.

Figure 3A:
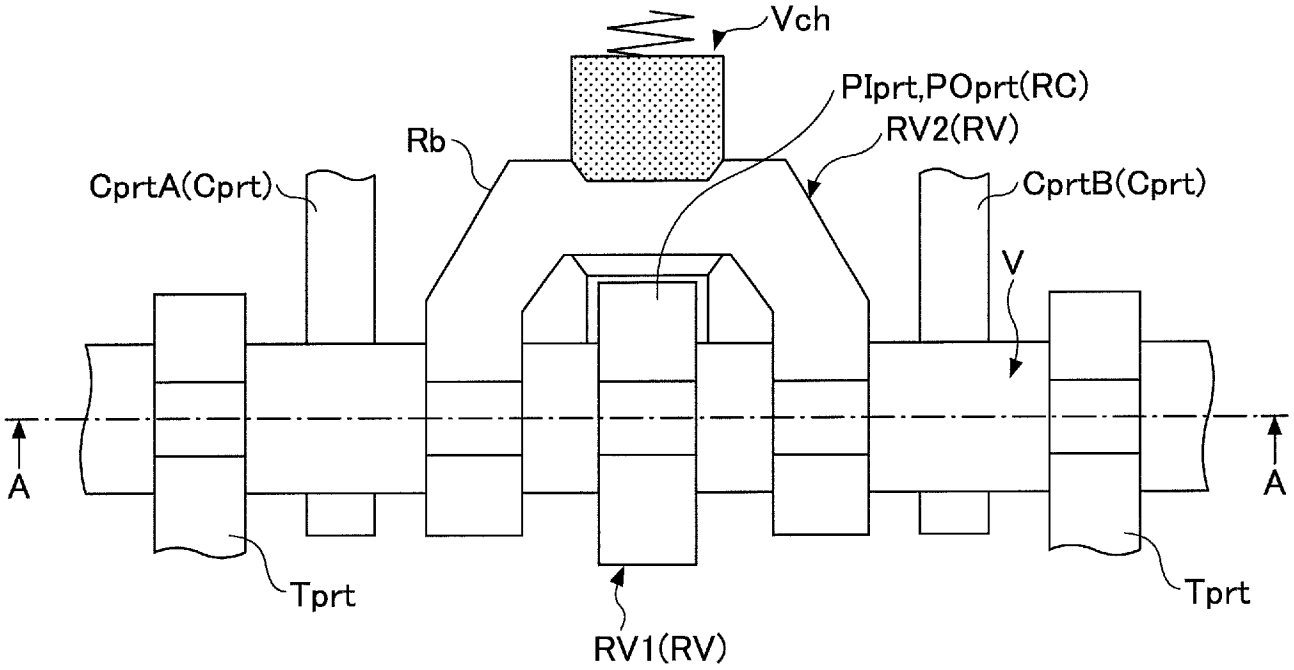
FIG. 3A illustrates an exemplary directional control valve of the hydraulic circuit of the construction machine of the embodiment.

As illustrated in FIG. 3A, the directional control valve V of the hydraulic circuit 20 of the embodiment includes an inlet port PIprt to which the pressurized oil is supplied through the center bypass passage RC, an outlet port POprt from which the pressurized oil supplied from the inlet port is flown into the center bypass passage RC, a cylinder port Cprt which supplies the pressurized oil supplied to the directional control valve V to the hydraulic cylinder, and a tank port Tprt which ejects the pressurized oil ejected from the hydraulic cylinder to an operating oil tank. In the hydraulic circuit 20 of the embodiment, a check valve Vch is arranged in an inlet of the second internal passage RV2, to which the pressurized oil is supplied.

Figure 3B:
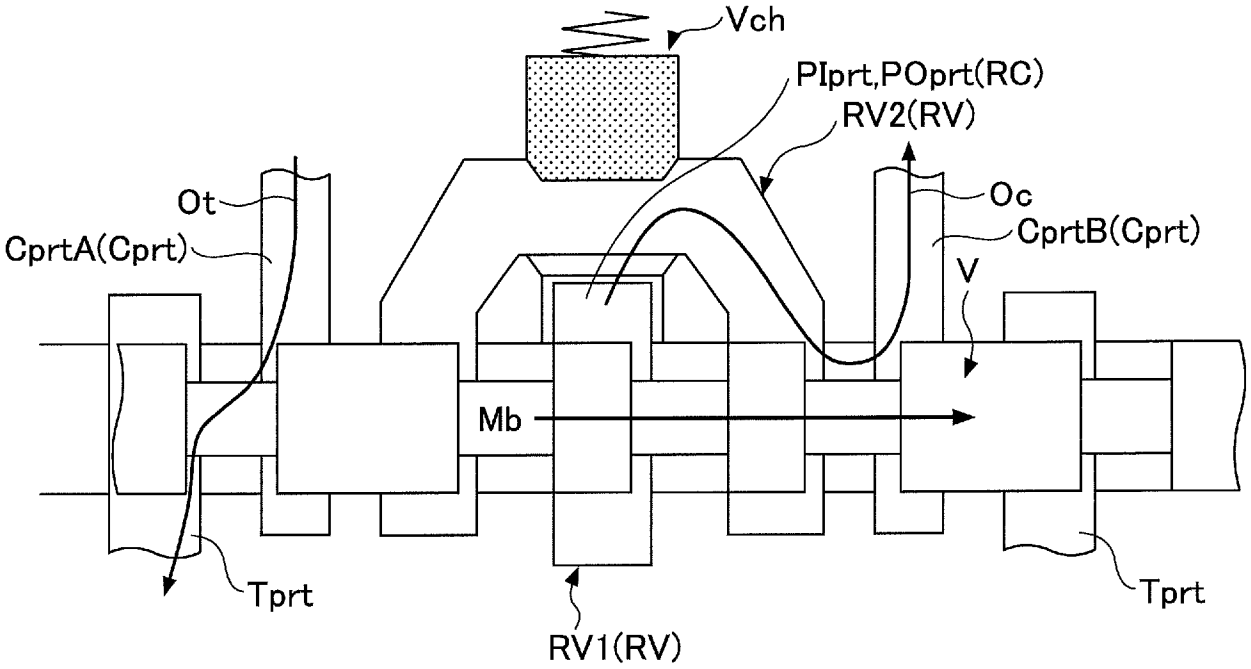
FIG. 3B illustrates the exemplary directional control valve of the hydraulic circuit of the construction machine of the embodiment.

As illustrated in FIG. 3B, the directional control valve V of the embodiment supplies the pressurized oil (the operating oil) Oc supplied from the center bypass passage RC to the hydraulic cylinder (e.g., 11*c* illustrated in FIGS. 1 and 2) from the cylinder port CprtB through the check valve Vch and the second internal passage RV2 in a case where the spool displaces (e.g., Mb illustrated in FIG. 3B). At this time, the pressurized oil (the operating oil) Ot ejected from the hydraulic cylinder to the cylinder port CprtA is ejected from the tank port Tprt to the operating oil tank.

Figure 3C:
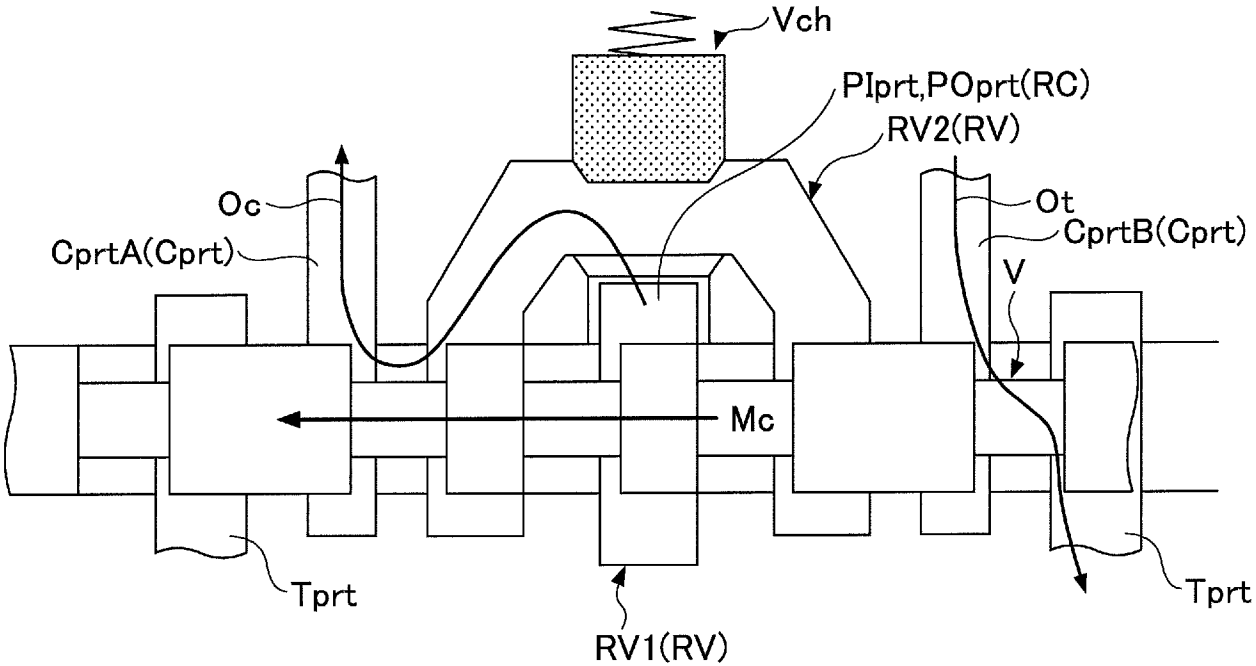
FIG. 3C illustrates the exemplary directional control valve of the hydraulic circuit of the construction machine of the embodiment.

As illustrated in FIG. 3C, the directional control valve V of the embodiment supplies the pressurized oil (the operating oil) Oc supplied from the center bypass passage RC to the hydraulic cylinder (e.g., 11*c* illustrated in FIGS. 1 and 2) from the cylinder port CprtA through the check valve Vch and the second internal passage RV2 in a case where the spool displaces (e.g., Mc illustrated in FIG. 3C). At this time, the pressurized oil (the operating oil) Ot ejected from the hydraulic cylinder to the cylinder port CprtB is ejected from the tank port Tprt to the operating oil tank.

Referring to FIGS. 3A-3C, in the hydraulic circuit 20 of the construction machine 100, because the bleed-off control is not performed in the directional control valve V (because the bleed opening is provided in the directional control valve V), the opening area of the first internal passage RV1 of the directional control valve V can be increased. Therefore, because the opening area of the first internal passage RV1 of the directional control valve V can be increased, a pressure loss of the pressurized oil passing through the center bypass passage RC can be decreased.

In the hydraulic circuit 20 of the construction machine 100 of the embodiment, by arranging the multiple directional control valves V in the center bypass passage RC in series, the parallel passage formed by the center bypass passage RC and the multiple first internal passages RV1 (the directional control valves V) functions. Therefore, because the parallel passage needs not to be separately provided in the hydraulic circuit 20 of the embodiment, the directional control valve can be miniaturized (the dimensions of the spool in the axial direction and the radius direction can be made small). In the hydraulic circuit 20 of the embodiment, for example, a bridge passage Rb (FIG. 3A) can be miniaturized.

In the hydraulic circuit 20 of the construction machine 100 of the embodiment, the pressurized oil is flown into the center bypass passage RC using the multiple directional control valves V. Said differently, in the hydraulic circuit 20 of the construction machine 100 of the embodiment, the pressurized oil is flown into the center bypass passage RC (the parallel passage) using the directional control valve group Gv.

Figure 4:
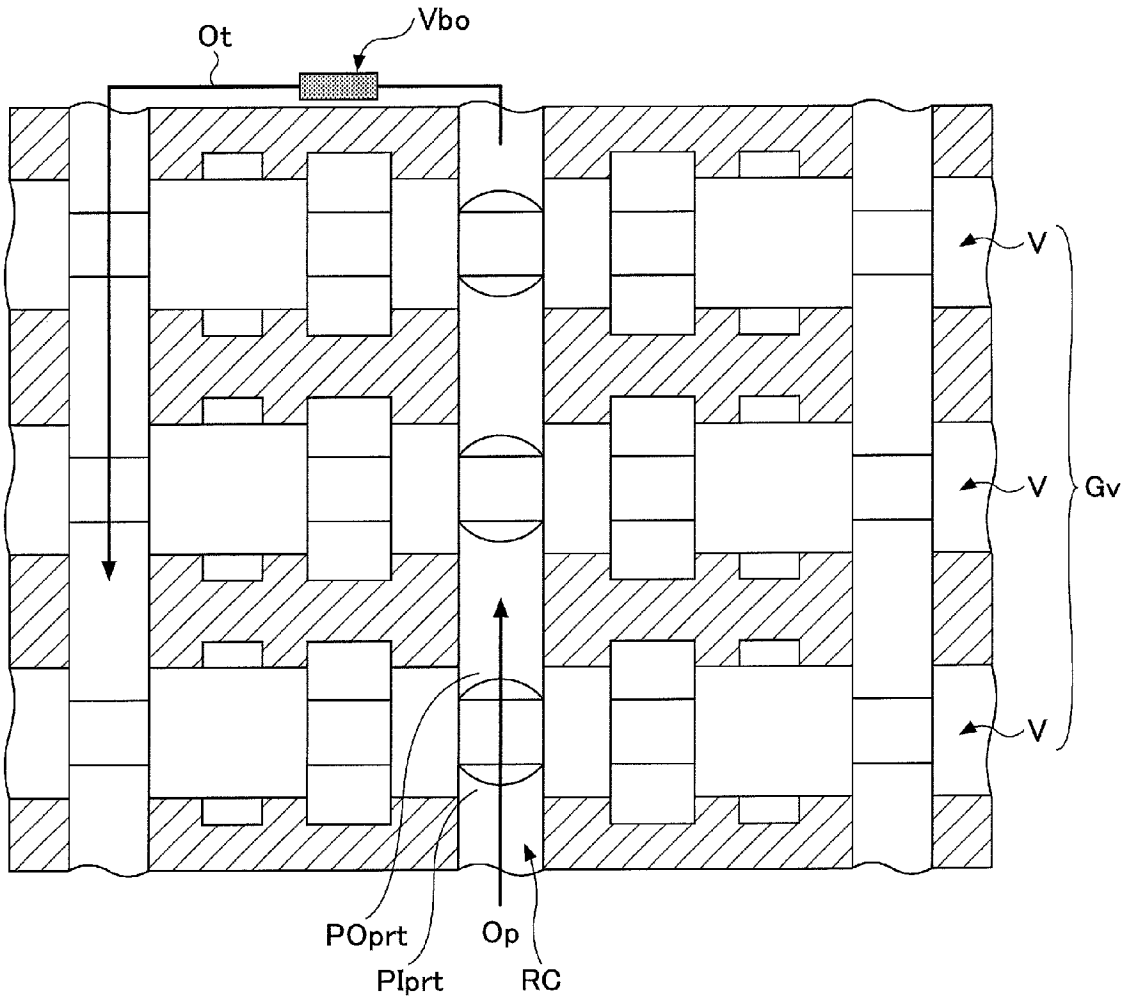
FIG. 4 is a schematic cross-sectional view illustrating an exemplary cross-sectional view (taken along a line A-A in FIG. 3A) of the hydraulic circuit of the construction machine of the embodiment.

Specifically, as illustrated in FIG. 4, the hydraulic circuit 20, in which the directional control valve group Gv (the multiple directional control valves V) is arranged, can have the parallel circuit formed by the first internal passage having substantially the same passage areas regardless of the position of the spool and the center bypass passage RC. In the hydraulic circuit 20, the pressurized oil Op supplied from the inlet port PIprt through the first internal passage RV1 of the directional control valve V is flown out of the outlet port POprt and flown into the center bypass passage RC. In the hydraulic circuit 20 of the embodiment, the bleed-off control (the standardized bleed-off control) can be performed using the bleed-off valve Vbo arranged on the most downstream side of the center bypass passage RC.

With this, in the hydraulic circuit 20 of the construction machine 100 of the embodiment, because it is unnecessary to provide each of the multiple bleed openings to each spool of the multiple directional control valves V (the directional control valve group Gv), the shape of the center bypass passage RC can be simplified. Further, because the number of curved portions of the center bypass passage RC can be diminished in the hydraulic circuit 20 of the embodiment, the pressure loss of the pressurized oil passing through the center bypass passage RC can be reduced.

In the hydraulic circuit 20 of the construction machine 100 of the embodiment, because the function of the parallel passage formed by the center bypass passage RC and the first internal passage RV1 is obtainable, and the pressure loss of the pressurized oil passing through the center bypass passage RC can be reduced by simplifying the shape of the center bypass passage RC (the parallel passage), it is possible to use the center bypass passage RC (the parallel passage) as a passage for supplying the pressurized oil merged by the merging circuit RJ to the desired directional control valve.

(Operation of Merging Pressurized Oil)

In the hydraulic circuit 20 of the construction machine 100 of the embodiment, the pressurized oil supplied to one center bypass passage is merged to another center bypass passage using the merging circuit RJ and the bleed-off valve Vbo (FIG. 2). The merging circuit RJ of the embodiment includes the merging directional control valve Vj. The merging circuit RJ of the embodiment further includes a check valve Vjc corresponding to the position (the inflow direction) of the spool of the merging directional control valve Vj.

The merging circuit RJ which can be used in the present invention is not limited to the merging circuit arranged on the upstream side of the bleed-off valve Vbo illustrated in FIG. 2. Said differently, the merging circuit RJ, to which the present invention is applicable, can be arranged at an arbitrary position (on the upstream side or the downstream side of an arbitrary directional control valve in the directional control valve group) of the center bypass passage RC provided in a gap between the hydraulic pump P and the bleed-off valve Vbo (the cut valve).

Figure 5A:
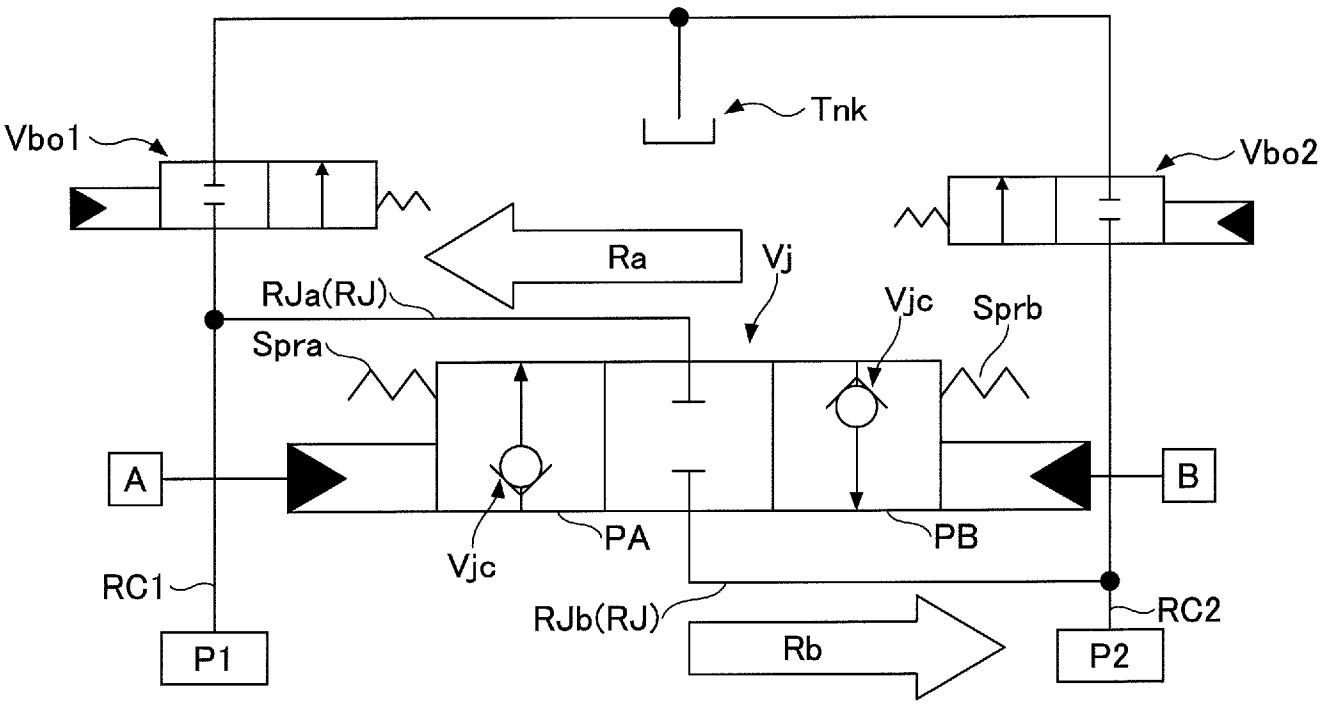
FIG. 5A illustrates a merging circuit for explaining an exemplary merging directional control valve of the hydraulic circuit of the construction machine of the embodiment.
Figure 5B:
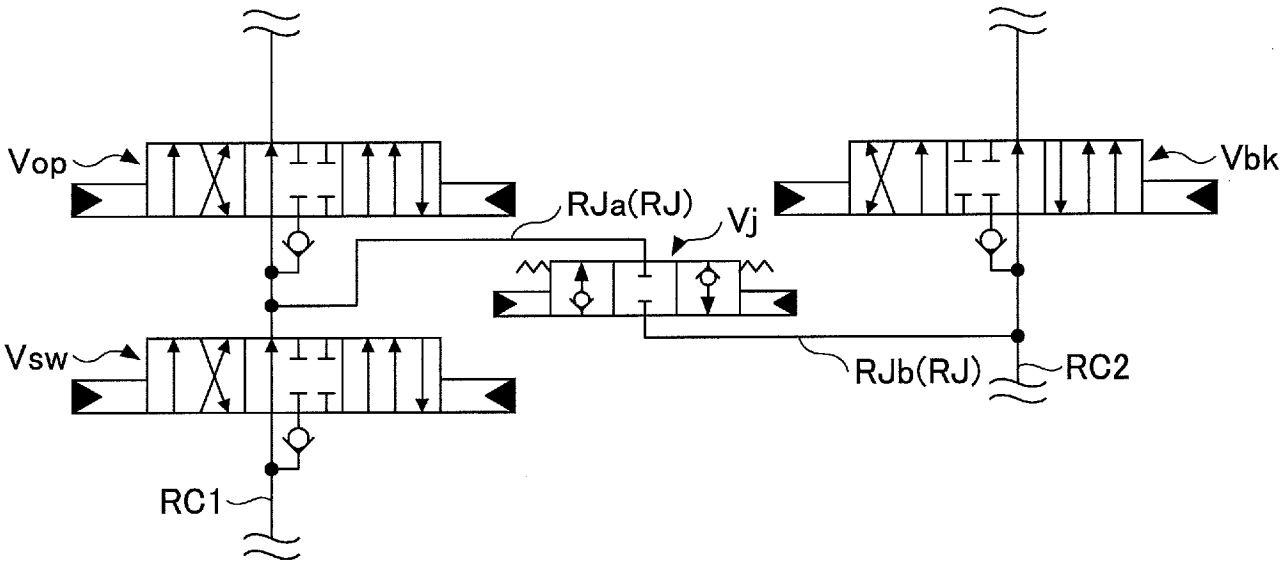
FIG. 5B illustrates the merging circuit for explaining the exemplary merging directional control valve of the hydraulic circuit of the construction machine of the embodiment.
Figure 5C:
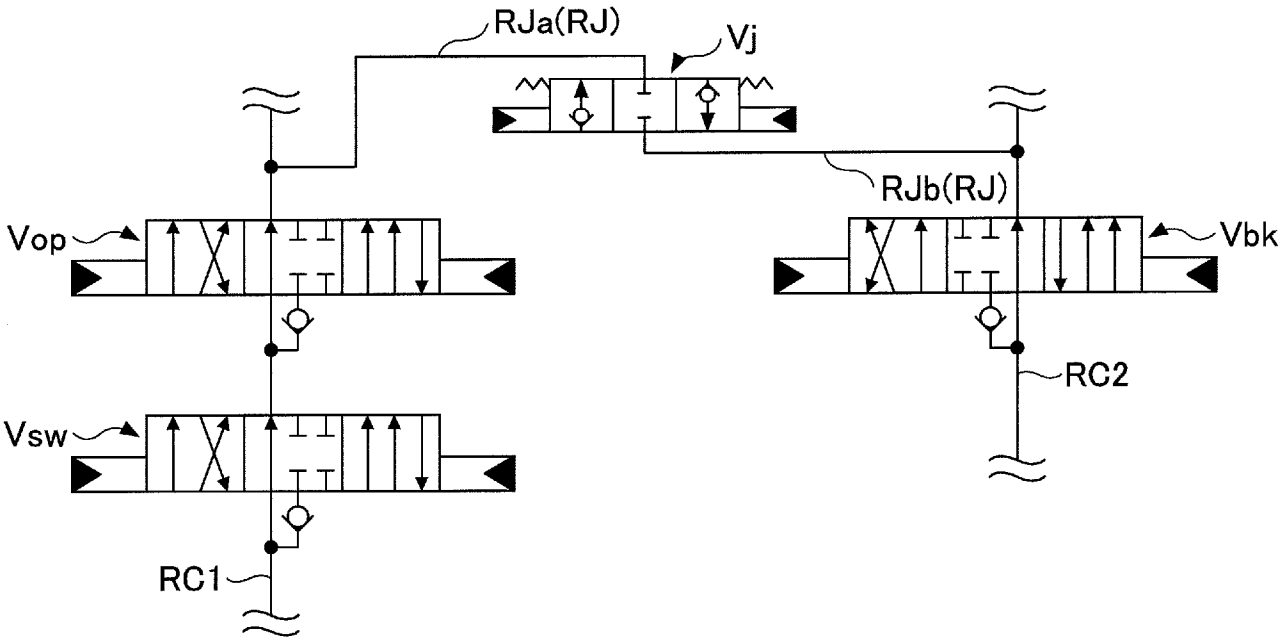
FIG. 5C illustrates the merging circuit for explaining the exemplary merging directional control valve of the hydraulic circuit of the construction machine of the embodiment.

The merging circuit RJ, to which the present invention is applicable, may be provided between the center bypass passage RC1 on the immediate upstream side of the auxiliary directional control valve Vop and the center bypass passage RC2 on the immediate upstream side of the directional control valve Vbk for the bucket as illustrated in FIG. 5B, or between the center bypass passage RC1 on the immediate downstream side of the auxiliary directional control valve Vop and the center bypass passage RC2 on the immediate downstream side of the directional control valve Vbk for the bucket as illustrated in FIG. 5C. At this time, in a case where the merging circuit RJ is used in the hydraulic circuit illustrated in FIG. 2, the position of the auxiliary directional control valve Vop and the position of the directional control valve for swivel Vsw are mutually replaced to substantialize a positional relationship between the auxiliary directional control valve Vop and the directional control valve Vbk for the bucket.

The merging circuit RJ of the embodiment controls the inflow direction of the pressurized oil inside the merging circuit RJ by changing the position of the spool in the merging directional control valve Vj. Further, the merging circuit RJ causes the pressurized oil generated by the pilot pump Pp (FIG. 2) to be input to a pilot port (a control port) of the merging directional control valve Vj thereby controlling the position of the spool of the merging directional control valve Vj. Further, the merging circuit RJ uses the pressure of the pressurized oil inside the center bypass passage raised by reducing the opening area of the bleed-off valve Vbo to supply (merge) the pressurized oil into the other center bypass passage.

Specifically, in the merging circuit RJ of the embodiment illustrated in FIG. 5A, pilot pressures (discharge pressures of the pilot pump Pp) A and B generated based on the operation information input in the construction machine 100 are input into control ports of the merging directional control valve Vj, respectively. At this time, the merging directional control valve Vj displaces the position (e.g., a position PA or PB in FIG. 5A) of the spool in response to the pilot pressures A and B and bias forces of springs Spra and Sprb. With this, the merging directional control valve Vj controls the inflow direction of the pressurized oil inside the merging circuit RJ. Further, the merging circuit RJ of the embodiment prevents the pressurized oil from flowing in an inverse direction of the inflow direction using the check valve.

For example, in order to cause the pressurized oil supplied to the center bypass passage RC1 to merge with the pressurized oil in the center bypass passage RC2 in the merging circuit RJ, the pressure of the pressurized oil inside the center bypass passage RC1 is raised and the position of the spool of the merging directional control valve Vj is displaced (Ra) to the position PA by decreasing the opening area of the bleed-off valve Vbo1. For example, in order to cause the pressurized oil supplied to the center bypass passage RC2 to merge with the pressurized oil in the center bypass passage RC1 in the merging circuit RJ, the pressure of the pressurized oil inside the center bypass passage RC2 is raised and the position of the spool of the merging directional control valve Vj is displaced (Rb) to the position PB by decreasing the opening area of the bleed-off valve Vbo2.

The method of changing the position of the spool of the merging directional control valve Vj is not limited to the above direction (a pressurizing method). The merging directional control valve Vj may be substantialized by, for example, a combination of a solenoid valve (switched ON/OFF) and another mechanical structure (of hydraulic pilot). The position of the spool of the merging directional control valve Vj is not limited to the above position (the positions PA and PB). The merging directional control valve Vj may be structured to cancel a shock caused by merging by proportionally switching over the merging directional control valve Vj irrespective of the operation amount of the lever. Further, the check valve Vjc may not be built in the merging directional control valve Vj.

(Control Device for the Construction Machine)

A controller 30C (FIG. 2) for controlling the entire operation of the construction machine 100 is installed in the control device 30 for the construction machine 100 of the embodiment. Here, the controller 30C (the control device 30) is provided to instruct operations to components of the construction machine 100 and controls the operations of the components. The controller 30C (the control device 30) may be structured by an arithmetic processing unit including a central processing unit (CPU), a memory (a ROM, a RAM, or the like), and so on.

As illustrated in FIG. 2, the controller 30C of the embodiment controls the operation of the regulator R (R1, R2) based on operation information (the operation amount and the operation direction of the operation lever) input in the construction machine 100. With this, the discharge amount of the hydraulic pump P (P1, P2) is controlled by the regulator R.

Further, the remote control pressure is generated by the controller 30C using a remote control valve or the like based on the operation information input in the construction machine 100. Subsequently, the controller 30C inputs the generated remote control pressure to the directional control valve (e.g., Vt1) using the remote control circuit (not illustrated). With this, the directional control valve can control the operating oil supplied to the hydraulic actuator by switching the position of the spool using the input remote control pressure.

Further, within the embodiment, the controller 30C controls the merging directional control valve Vj and the bleed-off valve Vbo based on the information input in the construction machine 100. The controller 30C controls the position of the spool of the merging directional control valve Vj and the opening degree (the opening area of) the bleed-off valve Vbo by controlling the discharge pressure of the pilot pump Pp, which is input in the merging directional control valve Vj and the bleed-off valve Vbo in response to, for example, a predetermined specific operating situation. As described, the controller 30C can control the inflow direction of the merging circuit and the pressure of the pressurized oil which flows out.

The control of the controller 30C is described in the following.

(1) For example, at a time when priority is given to an auxiliary hydraulic actuator, the controller 30C (the control device 30) can merge the pressure oil in the center bypass passage (e.g., RC1 illustrated in FIG. 2), in which the directional control valve (e.g., the auxiliary directional control valve Vop) corresponding to the hydraulic actuator whose operation is provided with the priority is arranged, and the pressure oil supplied to the other center bypass passage (e.g., RC2 illustrated in FIG. 2). With this, the controller 30C can give priority to the operation of the auxiliary hydraulic actuator.

(2) For example, at a time of a complex operation, the controller 30C (the control device 30) can merge the pressure oil in the center bypass passage (e.g., RC2 illustrated in FIG. 2), in which the directional control valve (e.g., the auxiliary directional control valve Vbk) corresponding to the hydraulic actuator (e.g., the bucket 13 illustrated in FIG. 1) whose operation is provided with the priority is arranged, with the pressure oil supplied to the other center bypass passage (e.g., RC1 illustrated in FIG. 2). With this, the controller 30C can give priority (an increase in the speed of the operation) to an operation of an arbitrary hydraulic actuator (the bucket 13).

As described, according to the hydraulic circuit 20 of the construction machine 100 and the control device 30 for the construction machine 100 of the embodiment, the pressurized oil discharged from the hydraulic pump P can be supplied to the downstream side of the center bypass passage RC using the first internal passage without the bleed-off control using the directional control valve. Therefore, the pressure loss of the pressurized oil passing through the center bypass passage RC can be reduced. Further, according to the hydraulic circuit 20 of the construction machine 100 and the control device 30 for the construction machine 100 of the embodiment, in a case where the merging circuit is formed, it is unnecessary to provide an output port on the upstream side of the cut valve (the bleed-off valve), an input port on a side of merging with the center bypass passage, and an outer passage for connecting the output port with the input port. Therefore, the hydraulic circuit can be miniaturized and the manufacture of the hydraulic circuit can be simplified. Further, according to the hydraulic circuit 20 of the construction machine 100 and the control device 30 for the construction machine 100 of the embodiment, because the inflow direction of the pressurized oil inside the merging circuit RJ can be controlled using the merging directional control valve Vj and the bleed-off valve Vbo, the pressurized oils can be bi-directionally merged in the multiple center bypass passages.

Further, according to the hydraulic circuit 20 of the construction machine 100 and the control device 30 for the construction machine 100 of the embodiment, the bleed-off control can be performed on the downstream side of the center bypass passage RC using the bleed-off valve Vbo arranged on the downstream side of the center bypass passage RC without the bleed-off control using the directional control valve (without providing the bleed opening in each directional control valve). Therefore, according to the hydraulic circuit 20 and the control device 30 of the embodiment, because the opening area of the internal passage (e.g., the first internal passage) of the directional control valve can be increased in comparison with a case where the bleed-off control is performed using the multiple directional control valves, the pressure loss of the pressurized oil passing through the center bypass passage RC can be reduced. Further, according to the hydraulic circuit 20 of the construction machine 100 and the control device 30 of the construction machine 100 of the embodiment, because the bleed opening is not provided with the directional control valve, the size of the directional control valve in the longitudinal direction can be made small. With this, according to the hydraulic circuit 20 and the control device 30 of the embodiment, the directional control valve can be miniaturized in comparison with a case where the bleed opening is formed in the directional control valve thereby facilitating the manufacture of the hydraulic circuit 20 and the control device 30.

Further, according to the hydraulic circuit 20 of the construction machine 100 and the control device 30 of the construction machine 100 of the embodiment, by arranging the multiple directional control valves V in the center bypass passage RC in series, the parallel passage formed by the center bypass passage RC and the first internal passage RV1 (the directional control valves V) functions. Further, according to the hydraulic circuit 20 and the control device 30 of the embodiment, because the parallel passage formed by the center bypass passage RC and the multiple first internal passages RV1 functions, it is unnecessary to separately provide the parallel passage. Therefore, the directional control valve V can be miniaturized. Further, according to the hydraulic circuit 20 and the control device 30 of the embodiment, because the bleed-off valve Vbo can function as a cut valve (a neutral cut valve) for the merging circuit RJ, it is unnecessary to newly provide a cut valve. With this, according to the hydraulic circuit 20 of the construction machine 100 and the control device 30 of the construction machine 100 of the embodiment, advantageous effects are given to the miniaturization of the entire size, the easiness in the manufacture, and the low cost of the construction machine 100.

Figure 6:
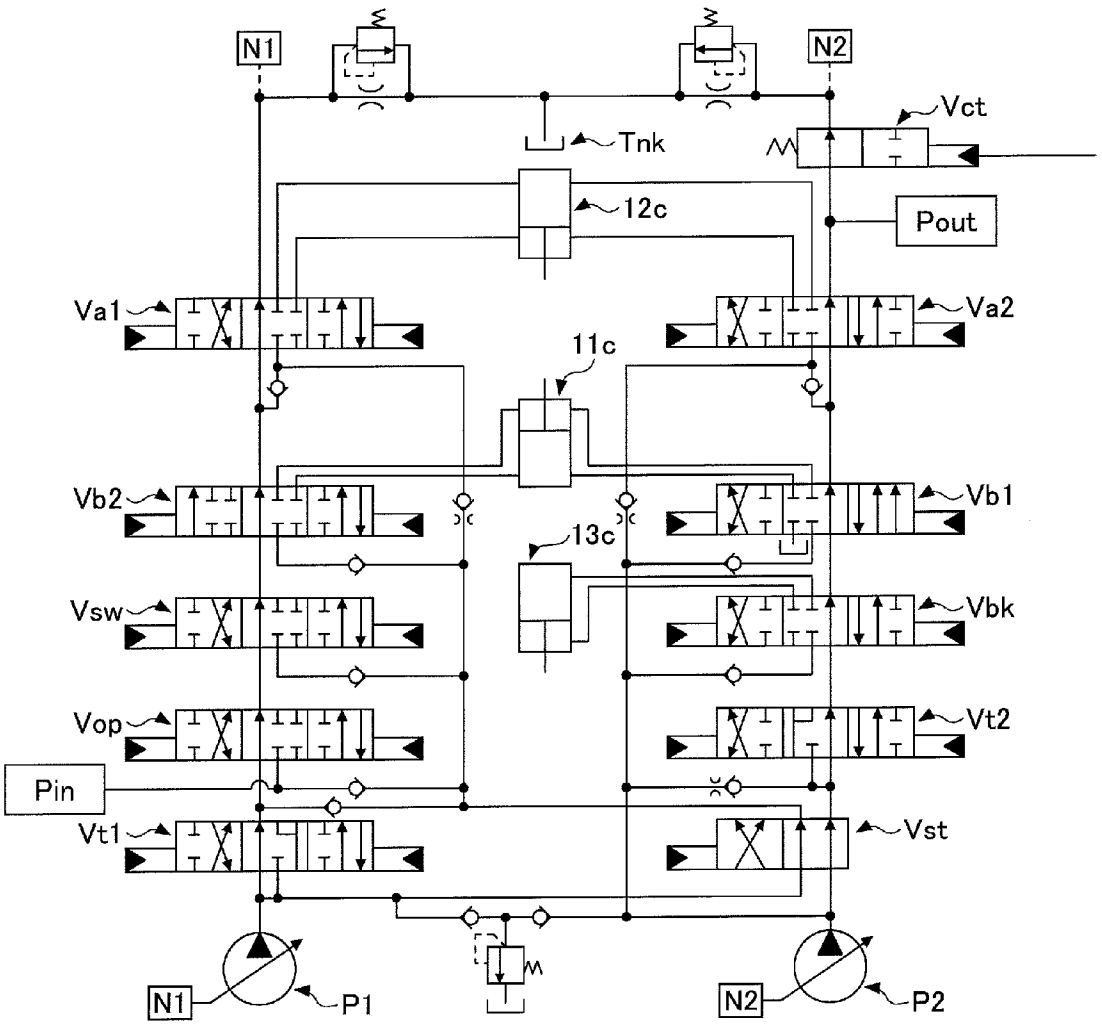
FIG. 6 illustrates a hydraulic circuit for illustrating another example of the hydraulic circuit of the construction machine.
Figure 7:
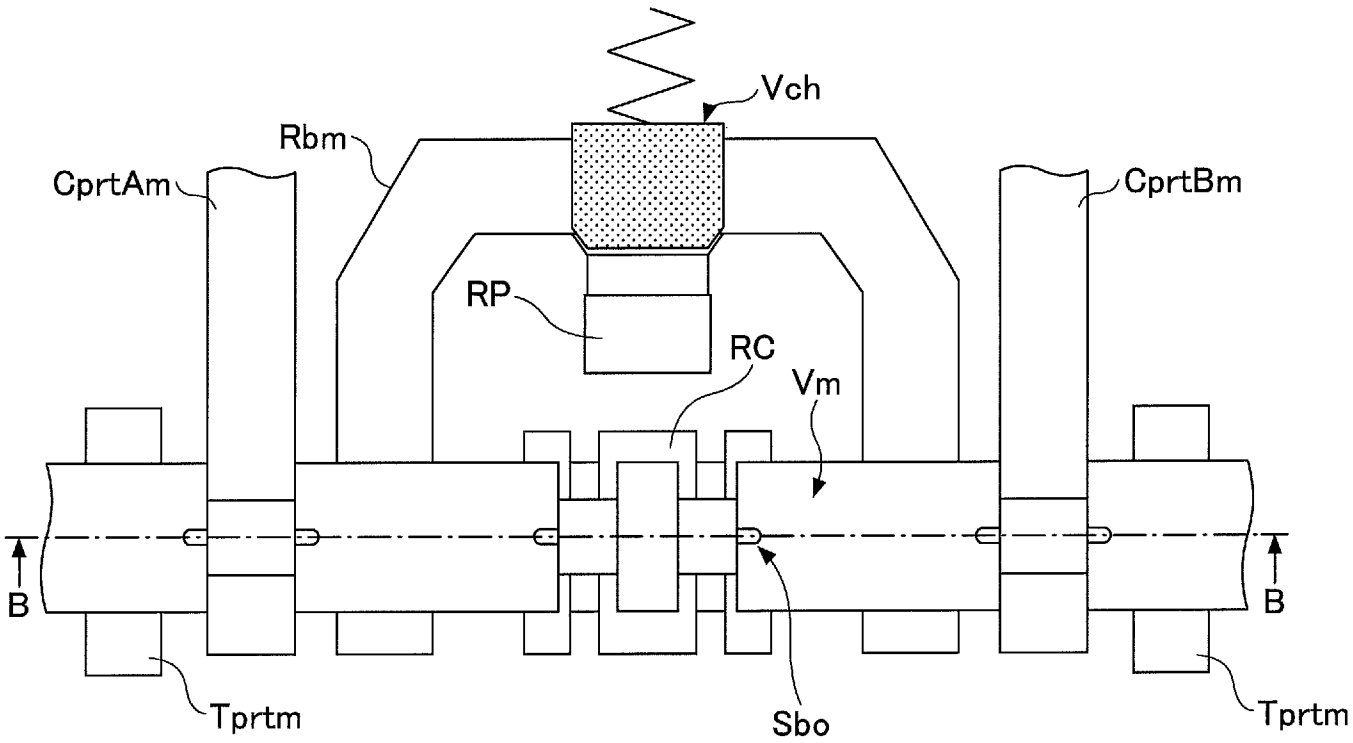
FIG. 7 illustrates another exemplary directional control valve of the hydraulic circuit of the construction machine.

Referring to FIG. 6, another example of the hydraulic circuit of the construction machine is illustrated. In the hydraulic circuit illustrated in FIG. 6, in order to perform the bleed-off control, the bleed opening (e.g., Sbo illustrated in FIG. 7) is formed in each spool of the directional control valves (e.g., Va1 or the like illustrated in FIG. 6). Said differently, the construction machine having the hydraulic circuit illustrated in FIG. 6 can perform the bleed-off control by changing the opening area of the bleed opening.

Figure 8:
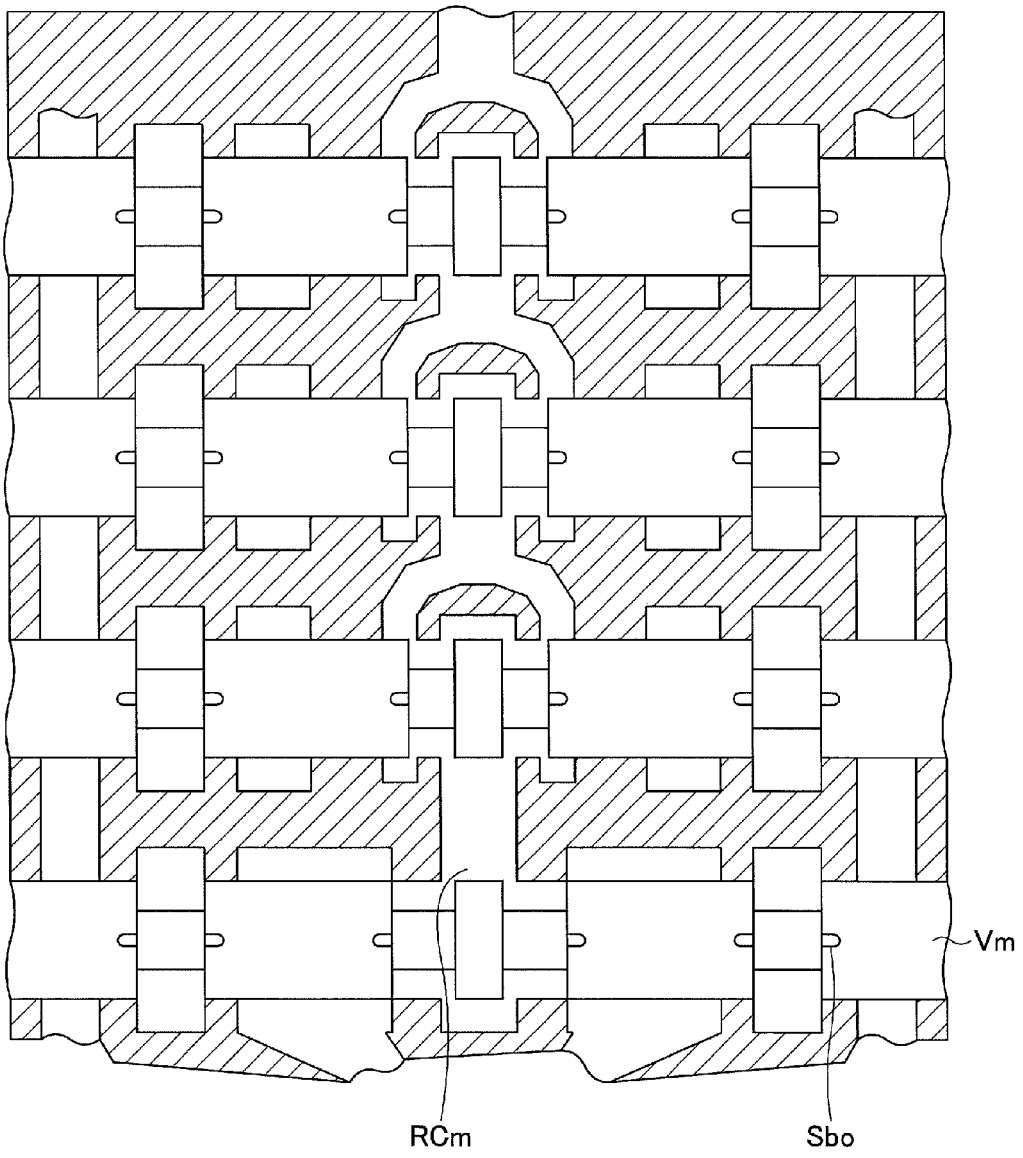
FIG. 8 is a schematic cross-sectional view illustrating another exemplary cross-sectional view (taken along a line B-B in FIG. 7) of the directional control valve of the hydraulic circuit of the construction machine of the embodiment.

In the construction machine having the hydraulic circuit illustrated in FIG. 6, because the bleed opening is formed in each spool of the directional control valves, there is a case where the pressure loss of the pressurized oil passing through the center passage (RCm illustrated in FIG. 8) increases in comparison with a case of the hydraulic circuit (FIG. 4) of the present invention.

Further, in the hydraulic circuit illustrated in FIG. 6, in order to form the merging circuit, the cut valve Vct and the output port Pout are provided to cause the pressurized oil to be flown out and the input port Pin is further provided to cause the pressurized oil to be flown in (merged). Therefore, there is case where the passage (for example, the passage connecting the output port Pout and the input port Pin) of the hydraulic circuit is complicated and the pressure loss of the pressurized oil increases. Further, in the hydraulic circuit illustrated in FIG. 6, it is necessary to provide another set of the cut valve Vct and the output port Pout or the like in order to enable bi-directional merging of the pressurized oils. Said differently, the size of the hydraulic circuit in a case of FIG. 6 may become greater than the size of the hydraulic circuit of the present invention (FIG. 4) because of the existence of the cut valve Vct, the output port Pout, or the like.

Heretofore, preferred embodiments of the present invention are described for the hydraulic circuit of the construction machine and the control device for the construction machine. However, the present invention is not limited to the above described embodiments. Further, the present invention can be variously modified or changed in the light of attached claims.

It should be understood that the invention is not limited to the above-described embodiment, but may be modified into various forms on the basis of the spirit of the invention. Additionally, the modifications are included in the scope of the invention."

Reference symbols are designated as follows:

100: construction machine;
11: boom;
11*c*: boom cylinder;
12: arm;
12*c*: arm cylinder;
13: bucket;
13*c*: bucket cylinder;
20: hydraulic circuit;
30: control unit;

30C: controller;
Gv: directional control valve group;
V: directional control valve (control valve);
Va1,Va2,Vb1,Vb2,Vbk,Vsw,Vop,Vt1,Vt2: directional control valve for hydraulic actuator;
Vst: directional control valve for direct travel (straight travel valve);
Vbo: bleed-off valve (cut valve);
Vch,Vjc: check valve;
Vj: merging directional control valve (switch valve, proportional switch valve, etc.);
RJ,RJa,RJb: merging circuit;
RC, RC1, RC2: center bypass passage (center bypass line);
RV1: first internal passage (internal passage for bleed-off, internal passage for PT opening);
RV2: second internal passage (internal passage for cylinder port);
PIprt: inlet port;
POprt: outlet port;
Tprt: tank port;
Cprt,CprtA,CprtB: cylinder port;
P,P1,P2: hydraulic pump;
R,R1,R2: regulator;
Tnk: operating oil tank (tank); and
Pp,Pp1,Pp2: pilot pump.

What is claimed is:

1. A hydraulic circuit of a construction machine including a plurality of center bypass passages, into which a pressurized oil discharged from a plurality of hydraulic pumps is supplied, the hydraulic circuit comprising:
a directional control valve group including a plurality of directional control valves that are arranged in tandem with the center bypass passages;
a bleed-off valve arranged on a downstream side of each center bypass passage relative to the directional control valve group; and
a merging circuit that merges the pressurized oil supplied into one center bypass passage of the plurality of center bypass passages and the pressurized oil in another center bypass passage of the plurality of center bypass passages,
wherein each directional control valve includes
a first internal passage that flows the pressurized oil supplied into the directional control valve out into each center bypass passage, and
a second internal passage that supplies the pressurized oil supplied to the directional control valve to a hydraulic actuator of the construction machine,
wherein the center bypass passage and the first internal passage form a parallel passage where the first internal passage flows the pressurized oil discharged from the hydraulic pump out onto downstream sides of the center bypass passage relative to the directional control valve,
wherein the bleed-off valve performs a bleed-off control for the pressurized oil supplied through the parallel passage by changing an opening area of the bleed-off valve,
wherein the merging circuit includes a merging directional control valve that is arranged on an upstream side of the bleed-off valve and controls an inflow direction of the pressurized oil
so that the pressurized oil in the one center bypass passage is merged into the pressurized oil in the another center bypass passage
to cause the hydraulic actuator corresponding to the directional control valve to be preferentially operated by the pressurized oil in the one center bypass passage through the parallel passage arranged in the another center bypass passage.

2. The hydraulic circuit of the construction machine according to claim 1,
wherein the first internal passage has substantially a same passage area regardless of a position of a spool included in each directional control valve and forms the parallel passage corresponding to the passage area,
wherein the directional control valve group is supplied with the pressurized oil from only the parallel passage.

3. The hydraulic circuit of the construction machine according to claim 1,
wherein a number of the plurality of hydraulic pumps is two,
wherein a number of the plurality of center bypass passages is two,
wherein the merging directional control valve switches over the inflow direction to supply one of pressurized oils respectively supplied to the two center bypass passages to the center bypass passage to which another of the pressurized oils is supplied.

4. The hydraulic circuit of the construction machine according to claim 1,
wherein the merging circuit further includes a check valve corresponding to the inflow direction, and prevents the pressurized oil from flowing in a direction inverse to the inflow direction.

5. A control device for controlling the hydraulic circuit of the construction machine according to claim 1.

6. The control device according to claim 5,
wherein the inflow direction is changed in response to operation information input into the construction machine.

7. The control device according to claim 5,
wherein the opening area of the bleed-off valve is decreased in a case where the pressurized oil is merged by the merging circuit.

* * * * *